US010950165B2

(12) United States Patent
Chang et al.

(10) Patent No.: US 10,950,165 B2
(45) Date of Patent: Mar. 16, 2021

(54) DISPLAY DEVICE

(71) Applicant: AU Optronics Corporation, Hsin-Chu (TW)

(72) Inventors: Che-Chia Chang, Hsin-Chu (TW); Ming-Hsien Lee, Hsin-Chu (TW); Chun-Fu Chung, Hsin-Chu (TW); Ming-Hung Chuang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/534,401

(22) Filed: Aug. 7, 2019

(65) Prior Publication Data

US 2020/0051486 A1 Feb. 13, 2020

Related U.S. Application Data

(60) Provisional application No. 62/717,260, filed on Aug. 10, 2018.

(30) Foreign Application Priority Data

Jan. 16, 2019 (TW) ..... 108101700

(51) Int. Cl.
*G09G 3/20* (2006.01)

(52) U.S. Cl.
CPC ... *G09G 3/2085* (2013.01); *G09G 2300/0408* (2013.01); *G09G 2310/0286* (2013.01); *G09G 2310/0297* (2013.01)

(58) Field of Classification Search
CPC ..... G09G 3/2085; G09G 2310/0281; G09G 2310/0297; G09G 2310/0408; G09G 2310/0286; G09G 3/3611; G09G 3/3674; G09G 3/3685; G09G 2310/08; G09G 2310/04
See application file for complete search history.

(56) References Cited

U.S. PATENT DOCUMENTS

2013/0127801 A1 5/2013 Hung et al.
2013/0187897 A1 7/2013 Liu
(Continued)

FOREIGN PATENT DOCUMENTS

CN 102419950 A 4/2012
CN 103218964 A 7/2013
(Continued)

*Primary Examiner* — Dennis P Joseph
(74) *Attorney, Agent, or Firm* — WPAT, PC

(57) ABSTRACT

A display device includes multiple shift register groups, multiple multiplexer groups, a driver IC, and multiple pixel circuits. The driver IC is configured to control the multiple shift register groups and the multiple multiplexer groups. A shift register group of the multiple shift register groups and a multiplexer group of the multiple multiplexer groups cooperatively drive a part of pixel circuits of the multiple pixel circuits. When the shift register group and the multiplexer group are enabled in a first time period, other shift register groups and other multiplexer groups are enabled in a second time period within the first time period. The first time period is longer than the second time period to render the part of pixel circuits and another part of pixel circuits to respectively have a first frame rate and a second frame rate.

9 Claims, 15 Drawing Sheets

(56) References Cited

U.S. PATENT DOCUMENTS

| | | | | |
|---|---|---|---|---|
| 2017/0162156 | A1* | 6/2017 | Zuo | G02F 1/13454 |
| 2018/0197455 | A1 | 7/2018 | Han et al. | |
| 2018/0211579 | A1* | 7/2018 | Bae | G09G 3/2003 |
| 2019/0027102 | A1 | 1/2019 | Hong | |
| 2019/0130861 | A1 | 5/2019 | Xing et al. | |
| 2019/0206329 | A1* | 7/2019 | Lee | G09G 3/3266 |

FOREIGN PATENT DOCUMENTS

| | | | |
|---|---|---|---|
| CN | 106663402 | | 5/2017 |
| CN | 106933527 | | 7/2017 |
| CN | 107481684 | A | 12/2017 |
| CN | 107577074 | A | 1/2018 |
| CN | 108037630 | | 5/2018 |

* cited by examiner

DISPLAY DEVICE

CROSS-REFERENCE TO RELATED APPLICATION

This application claims priority to U.S. Provisional Application Ser. No. 62/717,260, filed Aug. 10, 2018, and Taiwan Application Serial Number 108101700, filed Jan. 16, 2019, which are herein incorporated by reference in its entirety.

BACKGROUND

Technical Field

The present disclosure relates to a display device. More particularly, the present disclosure relates to a display device having sections capable of being respectively driven at different frame rates.

Description of Related Art

When a mobile device, which is available on the market, continuously display a still picture (e.g., one of the desktop pages), the mobile device usually decreases the display frame rate to reduce power consumption. When a user switches to the desktop during the playback of multimedia files, the playback software shrinks the playback area to a small section of the display and keeps playing the multimedia file. In this situation, the mobile device has to operate the whole display active area at a high frame rate, so as to ensure good visual experiences for the user. In other words, even if only one of the display sections needs the high frame rate, the mobile device will configure the whole active area to operate at the high frame rate which leads to a high power consumption.

SUMMARY

The disclosure provides a display device comprises a plurality of shift register groups, a plurality of multiplexer groups, a driver IC, and a plurality of pixel circuits. The driver IC is configured to control the plurality of shift register groups and the plurality of multiplexer groups. A shift register group of the plurality of shift register groups and a multiplexer group of the plurality of multiplexer groups cooperatively drive a part of pixel circuits of the plurality of pixel circuits. When the shift register group and the multiplexer group are enabled in a first time period, other shift register groups of the plurality of shift register groups and other multiplexer groups of the plurality of multiplexer groups are enabled in a second time period within the first time period. The first time period is longer than the second time period to render the part of the pixel circuits to have a first frame rate, and to render another part of pixel circuits of the plurality of pixel circuits to have a second frame rate.

It is to be understood that both the foregoing general description and the following detailed description are by examples, and are intended to provide further explanation of the disclosure as claimed.

DETAILED DESCRIPTION

Figure 1:
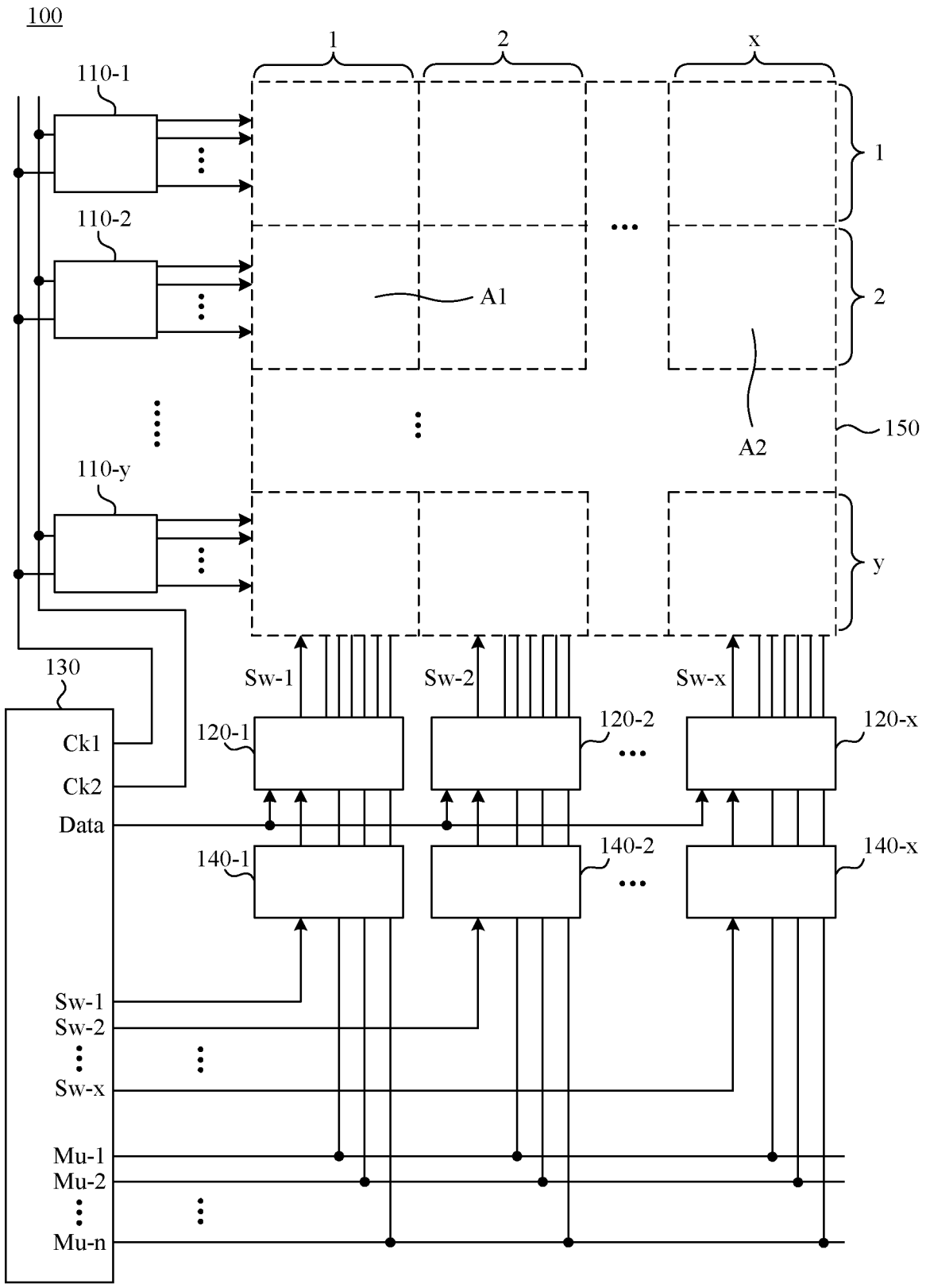
FIG. 1 is a simplified functional block diagram of a display device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a display device 100 according to one embodiment of the present disclosure. The display device 100 comprises a plurality of shift register groups 110-1~110-*y*, a plurality of multiplexer groups 120-1~120-*x*, a driver IC 130, a plurality of switching circuits 140-1~140-*x*, and an active area 150. A plurality of pixel circuits are arranged in the active area 150, and the active area 150 are divided into x times y sections according to a number of the shift register groups 110-1~110-*y* (i.e., y groups) and a number of the multiplexer groups 120-1~120-*x* (i.e., x groups). In addition, each of the sections comprises a part of the pixel circuits. The display device 100 is capable of operating one of the sections at a higher frame rate, while other sections are operated in a lower frame rate to reduce power consumption of the display device 100. For the sake of brevity, other functional blocks of the display device 100 are not shown in FIG. 1.

In practice, each of the multiplexer groups 120-1~120-*x* comprises a plurality of multiplexers. Each of the multiplexers may be realized by a 3-to-1 multiplexer or a 4-to-1 multiplexer. For example, in an embodiment that the active area 150 having a resolution of 1920×1080, each of the multiplexer groups 120-1~120-*x* has a number of multiplexers equaling to 1080 divided by x.

For the sake of brevity, the area surrounding the active area 150 is hereinafter refer to as "peripheral area," namely, the shift register groups 110-1~110-*y*, the multiplexer groups 120-1~120-*x*, the driver IC 130, and the switching circuits 140-1~140-*x* are disposed in the peripheral area.

The driver IC 130 is configured to provide a first clock group Ck1 or a second clock group Ck2 to the shift register groups 110-1~110-*y*. The first clock group Ck1 has a frequency higher than that of the second clock group Ck2. Each of the shift register groups 110-1~110-*y* is operated at a frequency corresponding to the received first clock group Ck1 or second clock group Ck2.

The switching circuits 140-1~140-*x* are configured to receive a plurality of multiplexing signals Mu-1~Mu-n from the driver IC 130, and also configured to correspondingly receive a plurality of switching signals Sw-1~Sw-x. For example, the switching circuit 140-1 is configured to receive the multiplexing signals Mu-1~Mu-n and the switching signal Sw-1. The switching circuit 140-2 is configured to receive the multiplexing signals Mu-1~Mu-n and the switching signal Sw-2, and so forth.

Throughout the specification and drawings, indexes 1~x and 1~y may be used in the reference labels of components and signals for ease of referring to respective components and signals. The use of indexes 1~x and 1~y does not intend to restrict the amount of components and signals to any specific number. In the specification and drawings, if a reference label of a particular component or signal is used without having the index, it means that the reference label is used to refer to any unspecific component or signals of corresponding component group or signals group. For example, the reference label 120-1 is used to refer to the specific multiplexer group 120-1, and the reference label 120 is used to refer to any unspecific multiplexer group of the multiplexer groups 120-1~120-*x*. In another example, the reference label Sw-1 is used to refer to the specific switching signal Sw-1, and the reference label Sw is used to refer to any unspecific switching signal of the switching signals Sw-1~Sw-x.

In this embodiment, the driver IC 130 switches a switching signal Sw between a first voltage level (e.g., a high voltage level) and a second voltage level (e.g., a low voltage level). When a switching circuit 140 receives the switching signal Sw having the first voltage level, the switching circuit 140 outputs the received multiplexing signals Mu-1~Mu-n to a multiplexer group 120 correspondingly coupled with the switching circuit 140. As a result, the multiplexer group 120 correspondingly coupled with the switching circuit 140 is enabled.

On the other hand, when the switching circuit 140 receives the switching signal Sw having the second voltage level, the switching circuit 140 is disabled from outputting the received multiplexing signals Mu-1~Mu-n. In this situation, the multiplexer group 120 correspondingly coupled with the switching circuit 140 is disabled.

The multiplexer group 120 is configured to receive a data signal Data from the driver IC 130, and to receive multiplexing signals Mu-1~Mu-n and the switching signal Sw from the switching circuit 140 correspondingly coupled with the multiplexer group 120. When the multiplexer group 120 is enabled, the multiplexer group 120 transmits the switching signal Sw having the first voltage level to pixel circuits within sections coupled with the multiplexer group 120. As a result, the pixel circuits coupled with the multiplexer group 120 are configured to be written by the data signal Data. In this situation, the multiplexer group 120 further transmits the data signal Data to the pixel circuits coupled with the multiplexer group 120 according to the received multiplexing signals Mu-1~Mu-n.

For example, when the multiplexer group 120-1 is enabled, the multiplexer group 120-1 transmits the data signal Data and the switching signal Sw having the first voltage level to pixel circuits within sections having an abscissa value of 1.

On the other hand, when the multiplexer group 120 is disabled, the multiplexer group 120 transmits the switching signal Sw having the second voltage level to pixel circuits within sections coupled with the multiplexer group 120. As a result, the pixel circuits coupled with the multiplexer group 120 are prevented from being written by the data signal Data. The circuit structures and operations of the pixel circuits will be further described in the following paragraphs.

It is worth mentioning that, the multiplexing signals Mu-1~Mu-n are configured to control operations of the multiplexers in the multiplexer group 120. In an embodiment that the multiplexers of the multiplexer group 120 are realized by 3-to-1 multiplexers, the driver IC 130 totally supplies three multiplexing signals Mu-1~Mu-3 to the multiplexer group 120. In another embodiment that the multiplexers of the multiplexer group 120 are realized by 4-to-1 multiplexers, the driver IC 130 totally supplies four multiplexing signals Mu-1~Mu-4 to the multiplexer group 120.

In this embodiment, the pixel circuits within each section are driven by one shift register group 110 and one multiplexer group 120 cooperatively. For example, pixel circuits within an area A1 at the position (1, 2) are driven by the shift register group 110-2 and the multiplexer group 120-1 cooperatively. In another example, pixel circuits within an area A2 at the position (x, 2) are driven by the shift register group 110-2 and the multiplexer group 120-*x* cooperatively.

In a situation that one of the sections of the display device 100 needs a high frame rate while other sections needs not that high frame rate, the driver IC 130 configures one shift register group 110 to operate at the high frequency according to the first clock group Ck1, and configures other shift register groups 110 to operate at the low frequency according to the second clock group Ck2. In this situation, the driver IC 130 further configures one multiplexer group 120 to be enabled for a longer time period, and configures other multiplexer groups 120 to be enabled for a shorter time period.

Therefore, the section, which is driven by the shift register group 110 operated at the high frequency and the multiplexer group 120 enabled for the longer time period, may have the high frame rate. On the contrary, other sections, which are driven by the shift register groups 110 operated at the low frequency and the multiplexer groups 120 enabled for the shorter time period, may have a low frame rate.

Figure 2:
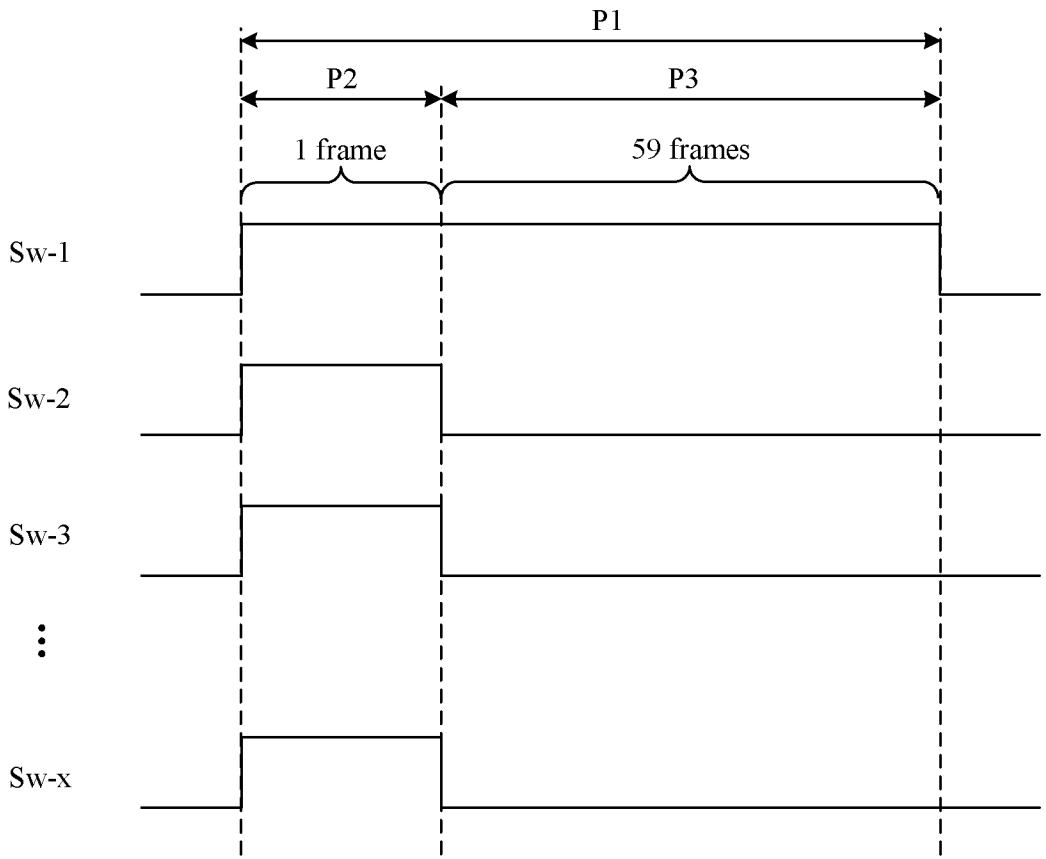
FIG. 2 illustrates schematic waveforms of switching signals according to one embodiment of the present disclosure.

The method for configuring the sections to have different frame rates will be specifically described in the following by referring to FIGS. 1 and 2. FIG. 2 illustrates schematic waveforms of the switching signals Sw-1~Sw-x according to one embodiment of the present disclosure. The switching signal Sw-1 is configured to remain at the first voltage level (e.g., the high voltage level) during a first time period P1. The switching signals Sw-2~Sw-x are configured to remain at the first voltage level during a second time period P2, and to remain at the second voltage level (e.g., the low voltage level) during a third time period P3 after the second time period P2.

Notably, the first time period P1 comprises the second time period P2 and the third time period P3, while the sum of lengths of the second time period P2 and the third time period P3 is equal to the length of the first time period P1. In this embodiment, the first time period P1 is one second, and the second time period P2 and the third time period P3 are 1/60 seconds and 59/60 seconds, respectively, but the disclosure is not limited to this embodiment. The lengths of the first time period P1, the second time period P2, and the third time period P3 may be adjusted according to actual design requirements.

In the first time period P1, the switching circuit 140-1 transmits the multiplexing signals Mu-1~Mu-n to the multiplexer group 120-1, so that the multiplexer group 120-1 is enabled. In the second time period P2, the switching circuits **140-2~140-*x* correspondingly transmit the multiplexing signals Mu-1~Mu-n to the multiplexer groups 120-2~120-*x*, so that the multiplexer groups 120-2~120-*x* are enabled. In addition, in the third time period P3, the switching circuits 140-2~140-*x* are disabled from outputting the multiplexing signals Mu-1~Mu-n, and thus the multiplexer groups 120-2~120-*x*** are disabled.

In this embodiment, the driver IC 130 configures the shift register group 110-2 to operate at the high frequency, and configures the shift register group 110-1 and the shift register groups **110-3~110-*y* to operate at the low frequency. Therefore, during the first time period P1, the shift register group 110-2 drives the correspondingly coupled pixel circuits for multiple times, namely, the shift register group 110-2 drives pixel circuits within the sections having the ordinate value of 2 for multiple times. On the other hand, the shift register group 110-1 and the shift register groups 110-3~110-*y* drive the correspondingly coupled pixel circuits only in the second time period P2, namely, the shift register group 110-1 and the shift register groups 110-3~110-*y*** drive the pixel circuits within the sections having the ordinate values of 1 and 3~y, respectively.

During the second time period P2, since the switching signals Sw-1~Sw-x have the first voltage level, all pixels circuits within the active area 150 are configured to be written by the data signal Data. Driven by the shift register groups **110-1~110-*y*, all pixel circuits within the active area 150 sequentially receive the data signal Data. Therefore, during the second time period P2, pictures respectively displayed by all sections of the active area 150** are updated to new frames.

Then, since the shift register group 110-1 and the shift register groups **110-3~110-*y* are operated at the low frequency, the shift register group 110-1 and the shift register groups 110-3~110-*y* are disabled from driving the correspondingly coupled pixel circuits during the third time period P3. Therefore, the sections driven by the shift register group 110-1 and the shift register groups 110-3~110-*y*** are disabling from updating their displayed pictures during the third time period P3.

On the other hand, since the shift register group 110-2 is operated at the high frequency, the shift register group 110-2 drives the correspondingly coupled pixel circuits for multiple times during the third time period P3. The switching signal Sw-1 remains at the first voltage level during the third time period P3 while the switching signals Sw-2~Sw-x has switched to the second voltage level, the pixel circuits within the sections having the abscissa values of 2~n are prevented from being written by the data signal Data.

In this situation, the pixel circuits within the area A1 are written by the data signal Data for multiple times during the third time period P3, so that the displayed picture of the area A1 is updated to multiple sequentially displayed frames (e.g., 59 frames) during the third time period P3. On the other hand, the sections having the abscissa values of 2~x and the ordinate value of 2 are prevented from being written by the data signal Data. Therefore, even though these sections are being driven by the shift register group 110-2 for multiple times, the displayed pictures of the sections having the abscissa values of 2~x and the ordinate value of 2 remain the same during the third time period P3.

As a result, the area A1 has a frame rate of 60 Hz, and other sections of the active area 150 have a frame rate of 1 Hz, however, the present disclosure is not limited by this embodiment. The frame of each section may be determined by adjusting the frequencies of first clock group Ck1 and the second clock group Ck2. In one embodiment, a frame rate of one section of the active area 150 is set to 60 Hz, while a frame rate of other sections is set to 15 Hz.

Figure 3A:
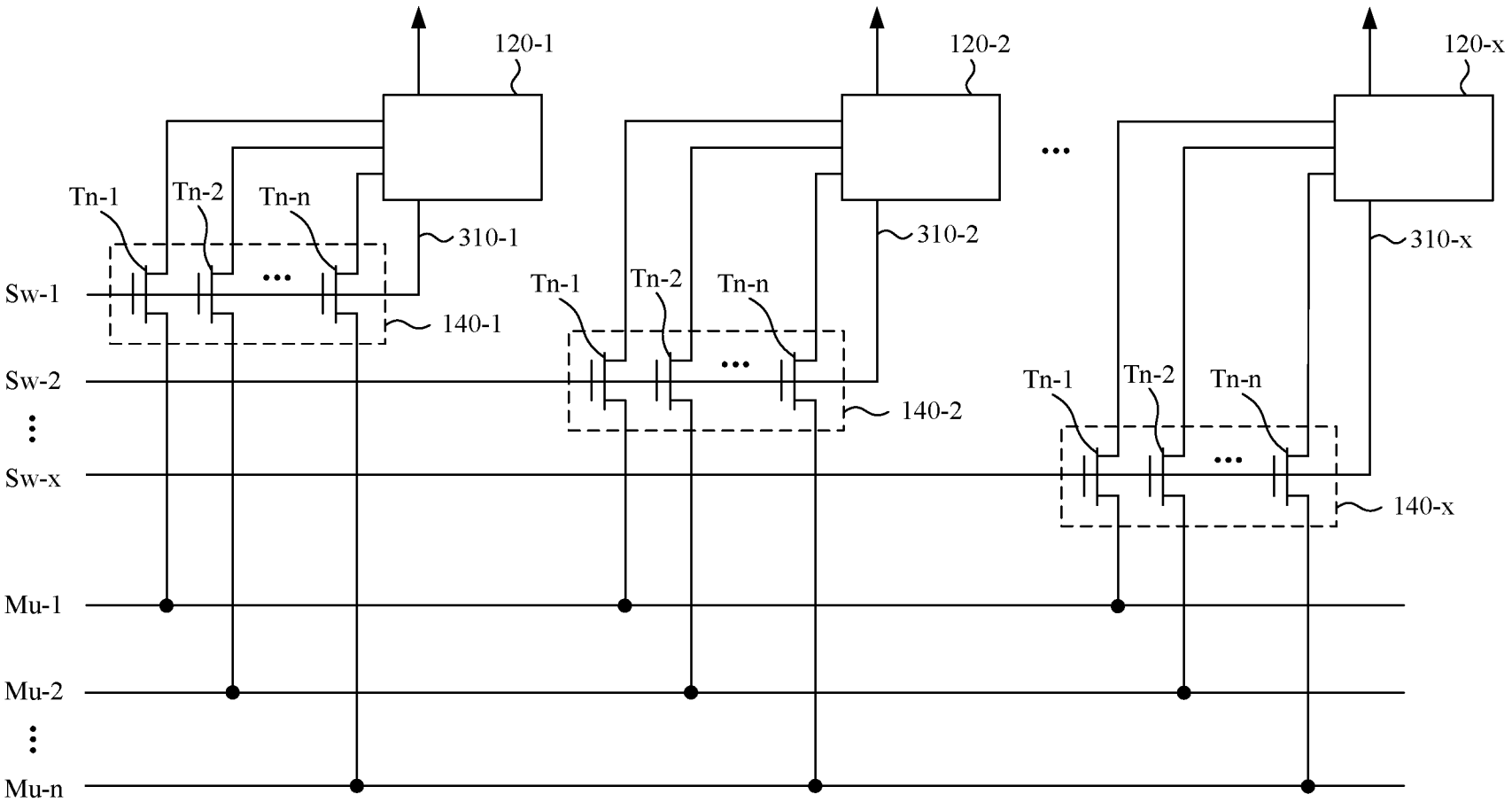
FIG. 3A is a simplified functional block diagram of part of a peripheral area according to one embodiment of the present disclosure.

FIG. 3A is a simplified block diagram of part of the peripheral area according to one embodiment of the present disclosure. As shown in FIG. 3A, the switching circuit 140 comprises a plurality of switches Tn-1~Tn-n. Each of the switches Tn-1~Tn-n comprises a first node, a second node, and a control node. The control nodes of the switches Tn-1~Tn-n are configured to receive one of the switching signals Sw-1~Sw-x. The first nodes of the switches Tn-1~Tn-n are each configured to correspondingly receive one of the multiplexing signals Mu-1~Mu-n. The second nodes of the switches Tn-1~Tn-n are coupled with the multiplexer group 120 correspondingly coupled with the switching circuit 140.

With respect to the switching circuit 140-1, the control nodes of the switches Tn-1~Tn-n are configured to receive the switching signal Sw-1; each of the first nodes of the switches Tn-1~Tn-n is configured to correspondingly receive one of the multiplexing signals Mu-1~Mu-n; and the second nodes of the switches Tn-1~Tn-n are coupled with the multiplexer group 120-1.

As shown in FIG. 3A, the display device 100 further comprises a plurality of peripheral signal lines **310-1~310-*x* arranged in the peripheral area. The peripheral signal lines 310-1~310-*x* are correspondingly coupled with the control nodes of the switches Tn-1~Tn-n of each of the switching circuits 140-1~140-*x*. The peripheral signal lines 310-1~310-*x* are configured to correspondingly transmit the switching signals Sw-1~Sw-x. For example, the peripheral signal line 310-1 is coupled with the control nodes of the switches Tn-1~Tn-n of the switching circuit 140-1, and configured to transmit the switching signal Sw-1. In another embodiment, the peripheral signal line 310-2 is coupled with the control nodes of the switches Tn-1~Tn-n of the switching circuit 140-2**, configured to transmit the switching signal Sw-2, and so forth.

Please refer to FIGS. 1 and 3A, the peripheral signal lines **310-1~310-*x* are extended from a first side (e.g., the left side) of the display device 100 to a second side (e.g., the right side) of the display device 100. The first side and second side of the display device 100 are opposite to each other. In other words, the peripheral signal lines 310-1~310-*x*** are extended toward the same side in this embodiment.

In practice, the switches Tn-1~Tn-n may be realized by N-type transistors of various suitable categories, such as N-type thin-film transistors (TFT).

Figure 3B:
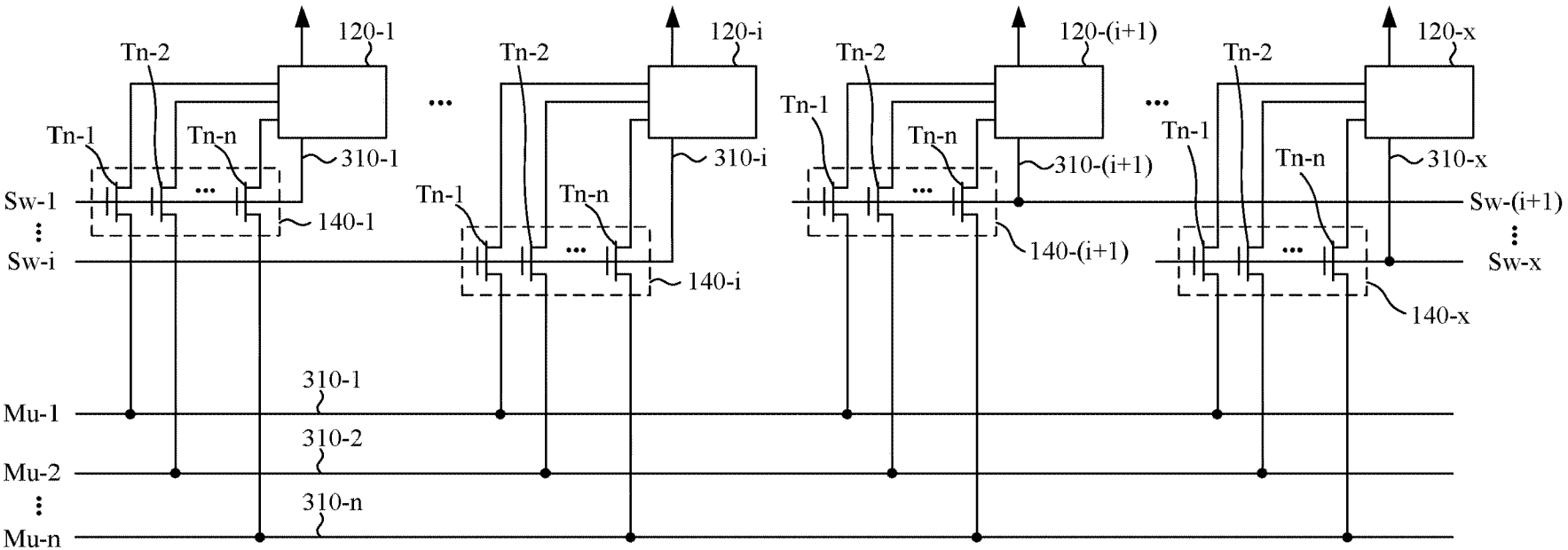
FIG. 3B is a simplified functional block diagram of the part of the peripheral area according to another embodiment of the present disclosure.

FIG. 3B is a simplified functional block diagram of the part of the peripheral area according to another embodiment of the present disclosure. The embodiment of FIG. 3B is similar to the embodiment of FIG. 3A, the differences are described as follows: the peripheral signal lines 310-1~310-*i* of the embodiment of FIG. 3B are extended from a first side of the display device 100 to a second side of the display device 100, while the peripheral signal lines 310-(*i*+1) ~310-*x* are extended from the second side of the display device 100 to the first side of the display device 100. The first side and the second side of the display device 100 are opposite to each other, and i is a positive integer smaller than x.

By dividing the peripheral signal lines 310-1~310-*x* into two parts that extended toward each other, the space required for wiring arrangement of the peripheral signal lines 310-1~310-*x* is reduced. Accordingly, the embodiment of FIG. 3B has an advantage of slim display border.

Figure 4A:
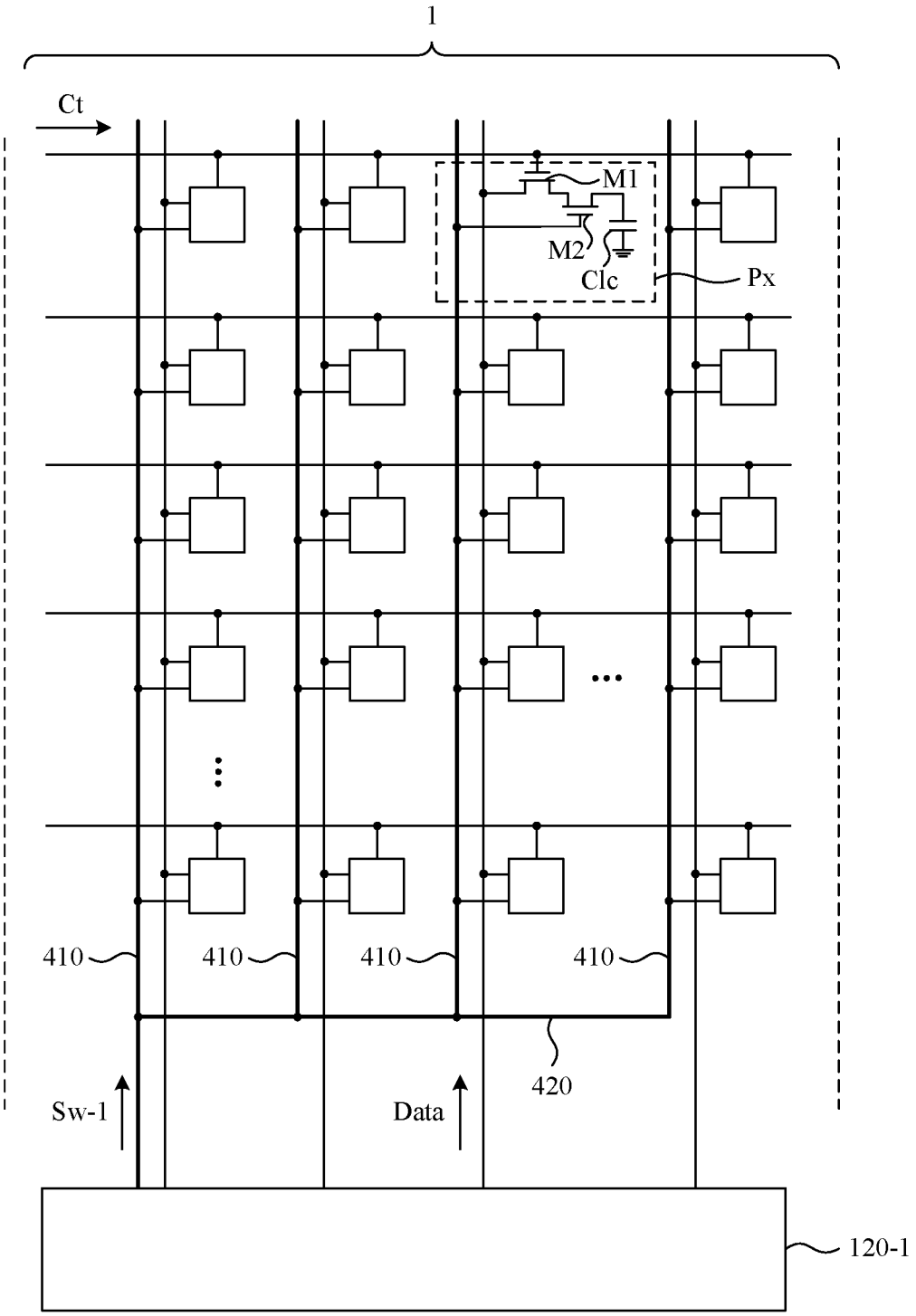
FIG. 4A is a simplified functional block diagram of a plurality of sections having the abscissa value of 1 in an active area according to one embodiment of the present disclosure.

FIG. 4A is a simplified functional block diagram of the plurality of sections having the abscissa value of 1 in the active area 150 according to one embodiment of the present disclosure. As shown in FIG. 4A, the active area 150 comprises a plurality of pixel circuits Px. The display device 100 further comprises a plurality of internal signal lines 410. The plurality of internal signal lines 410 are extended from the peripheral area into the active area 150, and the plurality of internal signal lines 410 are arranged alternatively with a plurality of columns of pixel circuits Px. One side of each of the plurality of internal signal lines 410 (e.g., the right side) is adjacent to a column of the pixel circuits Px.

In this embodiment, each of the plurality of internal signal lines 410 is coupled with the column of pixels PX adjacent to the right. A conductive path 420 is coupled to a first end of each of the plurality of internal signal lines 410. The plurality of internal signal lines 410 receive the switching signal Sw-1 from the multiplexer group 210-1 through the conductive path 420. Therefore, the plurality of internal signal lines 410 may transmit the switching signal Sw-1 to all of the pixel circuits Px in the sections having the abscissa value of 1, so as to determine whether the pixel circuits Px within the sections having the abscissa value of 1 can be written by the data signal Data.

The pixel circuit Px comprises a first transistor M1, a second transistor M2, and a capacitor element Clc. The first transistor M1 comprises a first node, a second node, and a control node. The first node of the first transistor M1 is configured to receive the data signal Data. The control node of the first transistor M1 is configured to receive the control signal Ct, and the control signal Ct is supplied by a corresponding shift register group 110. The second transistor M2 comprises a first node, a second node, and a control node. The first node of the second transistor M2 is coupled to the second node of the first transistor M1. The second node of the second transistor M2 is coupled with the capacitor element Clc. The control node of the second transistor M2 is coupled with one of the plurality of internal signal lines 410.

Please refer to FIGS. 2 and 4A, in the first time period P1, the second transistor M2 remains conducted because of receiving the switching signal Sw-1 having the first voltage level. Therefore, when the shift register group 110 applies the control signal Ct to conduct the first transistor M1, the data signal is transmitted to the capacitor element Clc via the first transistor M1 and the second transistor M2.

In practice, the first transistor M1 and the second transistor M2 may be realized by N-type transistors of various suitable categories. The capacitor element Clc may be realized by a liquid crystal layer filled between glass substrates.

The foregoing descriptions regarding the implementations, connections, operations, and related advantages of the sections having the abscissa value of 1 are also applicable to the sections having the abscissa value of 2~n. That is, the internal signal lines 410 in the active area 150 are divided into a plurality of groups. A number of the groups of the internal signal lines 410 is equal to that of the multiplexer groups 120-1~120-*x* (e.g., x groups), and internal signal lines 410 in the sections having the same abscissa value belong to the same group.

The internal signal lines 410 belonging to the same group are mutually coupled, and coupled to a corresponding multiplexer group 120. For example, the internal signal lines 410 in the sections having the abscissa value of 2 are mutually coupled, and coupled to the multiplexer group 120-2. In another example, the internal signal lines 410 in the sections having the abscissa value of 3 are mutually coupled, coupled to the multiplexer group 120-3, and so forth.

In some embodiments that having no specific requirements regarding to the width of the display border, the internal signal lines 410 in the active area 150 are not mutually coupled, and directly coupled to the driver IC 130. The switching signals Sw-1~Sw-x are supplied directly, by the driver IC 130, to the internal signal lines 410 in the active area 150, but are not supplied by the multiplexer groups 120-1~120-*x*. The foregoing descriptions regarding the implementations, connections, operations, and related advantages of other corresponding functional blocks of the embodiment of FIG. 4A are also applicable to these embodiments. For the sake of brevity, those descriptions will not be repeated here.

Figure 4B:
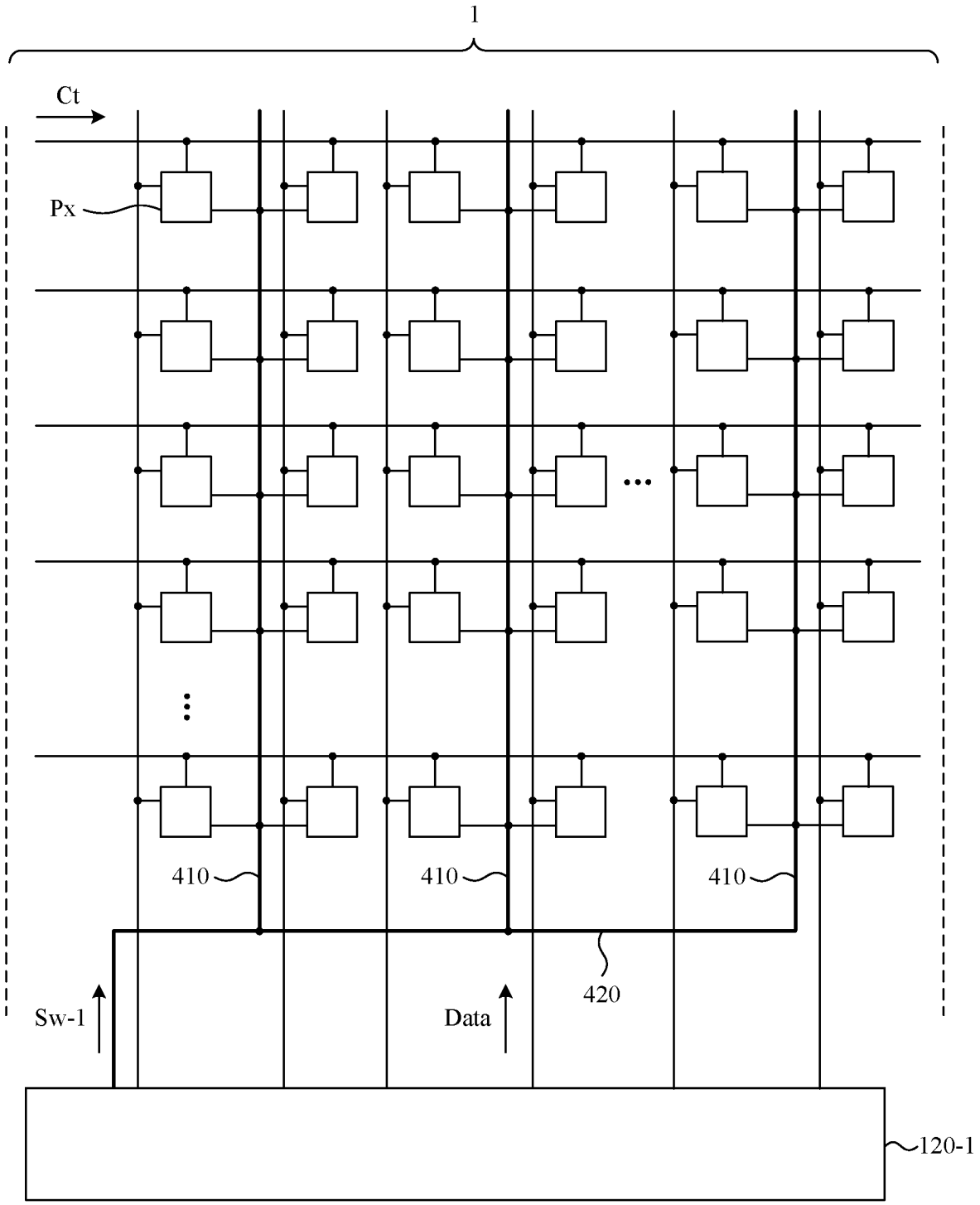
FIG. 4B is a simplified functional block diagram of the plurality of sections having the abscissa value of 1 in the active area according to another embodiment of the present disclosure.

FIG. 4B is a simplified functional block diagram of the plurality of sections having the abscissa value of 1 within the active area 150 according to another embodiment of the present disclosure. The embodiment of FIG. 4B is similar to the embodiment of FIG. 4A, and the differences are described as follows: in the embodiment of FIG. 4B, each of the plurality of internal signal lines 410 are arranged between two columns of pixel circuits Px, and each two neighbor internal signal lines 410 are separated by two columns of pixel circuits Px. Each of the plurality of internal signal lines 410 are coupled with two columns of pixel circuits Px respectively adjacent to the left and right sides of the internal signal line 410, so as to provide the switching signal Sw-1 to the two columns of pixel circuits Px coupled with the internal signal line 410.

The foregoing descriptions regarding the implementations, connections, operations, and related advantages of the sections having the abscissa value of 1 are also applicable to the sections having the abscissa value of 2~n. In this embodiment, two neighbor columns of pixel circuits Px are coupled with the same internal signal line 410, and thus the number of internal signal lines 410 can be decreased and the aperture ratio of the active area 150 can be increased.

Figure 4C:
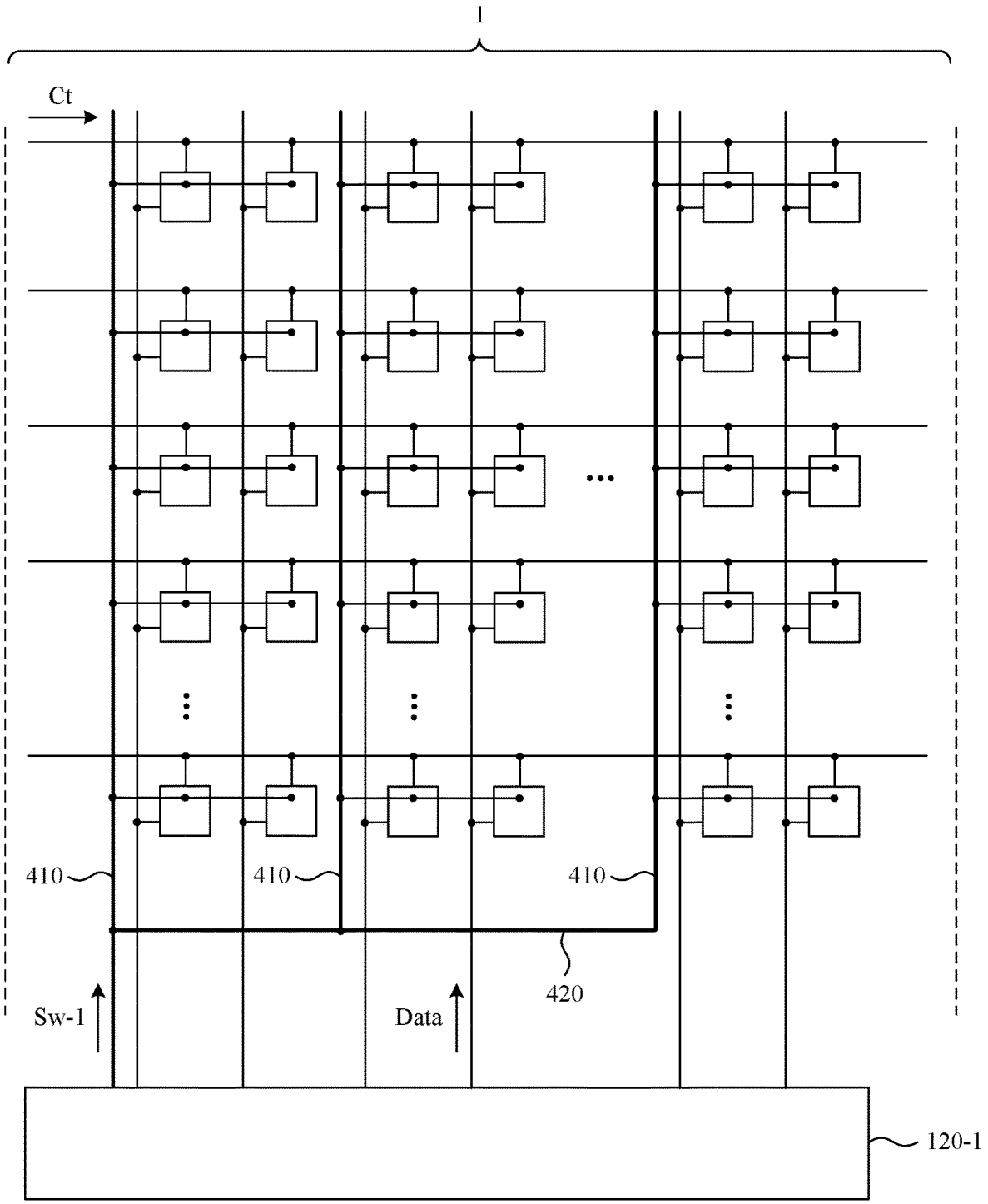
FIG. 4C is a simplified functional block diagram of the plurality of sections having the abscissa value of 1 in the active area according to yet another embodiment of the present disclosure.

FIG. 4C is a simplified functional block diagram of the plurality of sections having the abscissa value of 1 in the active area 150 according to yet another embodiment of the present disclosure. The embodiment of FIG. 4C is similar to the embodiment of FIG. 4A, the differences are described as follows: each of the plurality of internal signal lines 410 provides the switching signal Sw-1 to a plurality of columns of pixel circuits Px arranged sequentially at a same side of the internal signal lines 410. For example, the leftmost internal signal line 410 of FIG. 4C provides the switching signal Sw-1 to two columns of pixel circuits Px arranged sequentially at the right side of the leftmost internal signal line 410.

Notably, the number of columns of pixel circuits Px between any two neighbor internal signal lines 410 is merely an exemplary embodiment, and is not intend to restrict the practical implantations of this embodiment. The number of columns of pixel circuits Px between any two neighbor internal signal lines 410 may be adjusted according to practical impedance of the internal signal lines 410, or be adjusted according to other requirements of the design.

The foregoing descriptions regarding the implementations, connections, operations, and related advantages of the sections having the abscissa value of 1 are also applicable to the sections having the abscissa value of 2~n. in this embodiment, a plurality of columns of pixel circuits Px, which are arranged sequentially, are mutually coupled via one internal signal line 410, and thus this embodiment has advantages such as less signal lines and high aperture ratio.

Figure 5:
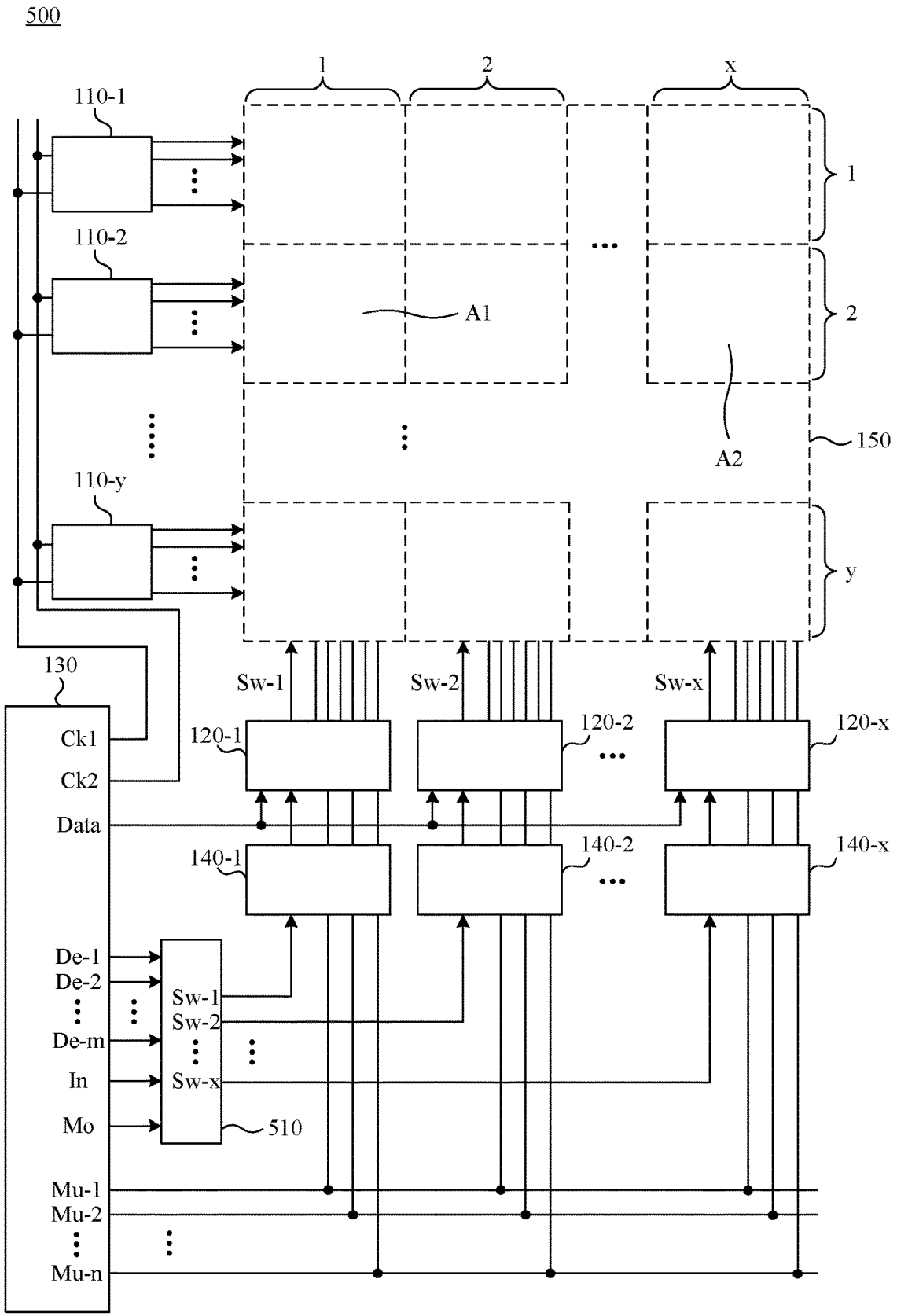
FIG. 5 is simplified a simplified functional block diagram of a display device according to another embodiment of the present disclosure.

FIG. 5 is simplified a simplified functional block diagram of a display device 500 according to one embodiment of the present disclosure. The display device 500 is similar to the display device 100, and the differences are described as follows: the switching signals Sw-1~Sw-x are outputted from the demultiplexer 510 to the switching circuits 140-1~140-*x*, and are not outputted by the driver IC 130.

The demultiplexer 510 is configured to receive a plurality of demultiplexing signals De-1~De-m, an input signal In, and a mode determining signal Mo from the driver IC 130, wherein m is a positive integer and x equals m-th powers of 2. The demultiplexer 510 is configured to determine the voltage levels of the switching signals Sw-1~Sw-x in accordance to the demultiplexing signals De-1~De-m and the mode determining signal Mo.

When the mode determining signal Mo has a third voltage level (e.g., a high voltage level), the demultiplexer 510 configures one switching signal Sw to have the first voltage level according to the demultiplexing signals De-1~De-m, and also configures other switching signals Sw to have the second voltage level. In this situation, one of the sections of the active area 150 may have the high frame rate.

On the other hand, when the mode determining signal Mo has a fourth voltage level (e.g., a low voltage level), the demultiplexer 510 configures each of the switching signals Sw-1~Sw-x to have the first voltage level. In this situation, all of the sections of the active area 150 have the high frame rate.

In other words, the driver IC 130 of the display device 500 uses less signals to determine the operation status of the active area 150. Therefore, the driver IC 130 of the display device 500 needs less output pins, which renders the display device 500 has an advantage of low manufacturing cost.

Figure 6:
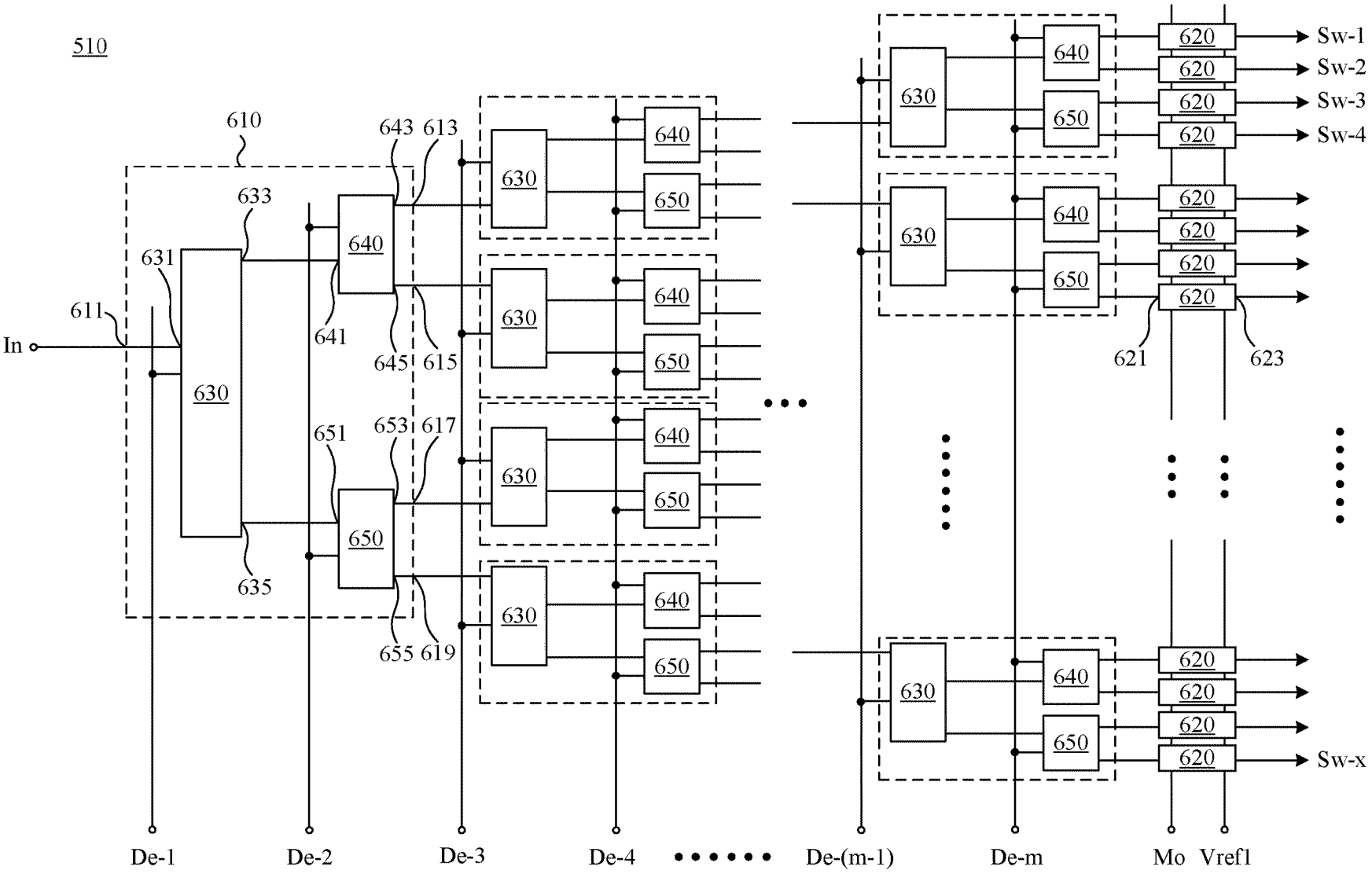
FIG. 6 is a simplified functional diagram of a demultiplexer according to one embodiment of the present disclosure.

FIG. 6 is a simplified functional diagram of a demultiplexer 510 according to one embodiment of the present disclosure. The demultiplexer 510 comprises a plurality of path selecting circuits 610 and a plurality of mode determining circuits 620. Each path selecting circuit 610 is configured to receive two of the demultiplexing signals De-1~De-m having the continuous index numbers. For example, one path selecting circuit 610 is configured to receive the demultiplexing signal De-1 and the demultiplexing signal De-2, while another path selecting circuit 610 is configured to receive the demultiplexing signal De-2 and the demultiplexing signal De-3.

Each path selecting circuit 610 comprises an input node 611, a first output node 613, a second output node 615, a third output node 617, and a fourth output node 619. The input node 611 of the path selecting circuit 610 is configured to receive the input signal In, or coupled with the first output node 613, the second output node 615, the third output node 617, or the fourth output node 619 of another path selecting circuit 610.

The first output nodes 613, the second output nodes 615, the third output nodes 617, and the fourth output nodes 619 of a part of the path selecting circuits 610 are each coupled with an input node 611. The first output nodes 613, the second output nodes 615, the third output nodes 617, and the fourth output nodes 619 of another part of the path selecting circuits 610 are each coupled with a mode determining circuit 620.

Each mode determining circuit 620 is configured to receive the mode determining signal Mo and a first reference voltage Vref1, and comprises an input node 621 and a first output node 623. The input node 621 of the mode determining circuit 620 is correspondingly coupled with a path selecting circuit 610. The first output node 623 of the mode determining circuit 620 is coupled with one of the switching circuits 140-1~140-*x*.

In this embodiment, the first reference voltage Vref1 has the first voltage level. According to the two received demultiplexing signals De, the path selecting circuit 610 conducts the input node 611 with one of the first output node 613, the second output node 615, the third output node 617, and the fourth output node 619.

When the mode determining signal Mo has the third voltage level, the mode determining circuits 620 conduct the switching circuits 140-1~140-*x* with the corresponding path selecting circuits 610. Accordingly, a transmitting path of the input signal In can be determined by the path selecting circuits 610, so that the input signal In can be selectively transmitted to one of the switching circuits 140-1~140-*x* as the switching signal Sw having the first voltage level.

On the other hand, when the mode determining signal Mo has the fourth voltage level, the mode determining circuits 620 are disabled from conducting the switching circuits 140-1~140-*x* with the path selecting circuits 610. The mode determining circuits 620 output the first reference voltage Vref1 to each of the switching circuits 140-1~140*x*. As a result, the switching circuits 140-1~140-*x* receive the switching signals Sw-1~Sw-x having the first voltage level, respectively.

As shown in FIG. 6, the path selecting circuit 610 comprises a first selecting circuit 630, a second selecting circuit 640, and a third selecting circuit 650. The circuit structure of the path selecting circuit 610 will be further described in the following by taking the path selecting circuit 610 receiving the demultiplexing signal De-1 and the demultiplexing signal De-2 as an example.

The first selecting circuit 630 is configured to receive the demultiplexing signal De-1, and comprises an input node 631, a first output node 633, and a second output node 635. The input node 631 of the first selecting circuit 630 is coupled with the input node 611 of the path selecting circuit 610.

The second selecting circuit 640 is configured to receive the demultiplexing signal De-2, and comprises an input node 641, a first output node 643, and a second output node 645. The input node 641 of the second selecting circuit 640 is coupled with the first output node 633 of the first selecting circuit 630. The first output node 643 of the second selecting circuit 640 is coupled with the first output node 613 of the path selecting circuit 610. The second output node 645 of the second selecting circuit 640 is coupled with the second output node 615 of the path selecting circuit 610.

The third selecting circuit 650 is configured to receive the demultiplexing signal De-2, and comprises an input node 651, a first output node 653, and a second output node 655. The input node 651 of the third selecting circuit 650 is coupled with the second output node 635 of the first selecting circuit 630. The first output node 653 of the third selecting circuit 650 is coupled with the third output node 617 of the path selecting circuit 610. The second output node 655 of the third selecting circuit 650 is coupled with the fourth output node 619 of the path selecting circuit 610.

The foregoing descriptions regarding the implementations, connections, operations, and related advantages of the path selecting circuit 610 receiving the demultiplexing signal De-1 and the demultiplexing signal De-2 are also applicable to other path selecting circuits 610 of the demultiplexer 510. For the sake of brevity, those descriptions will not be repeated here.

Figure 7:
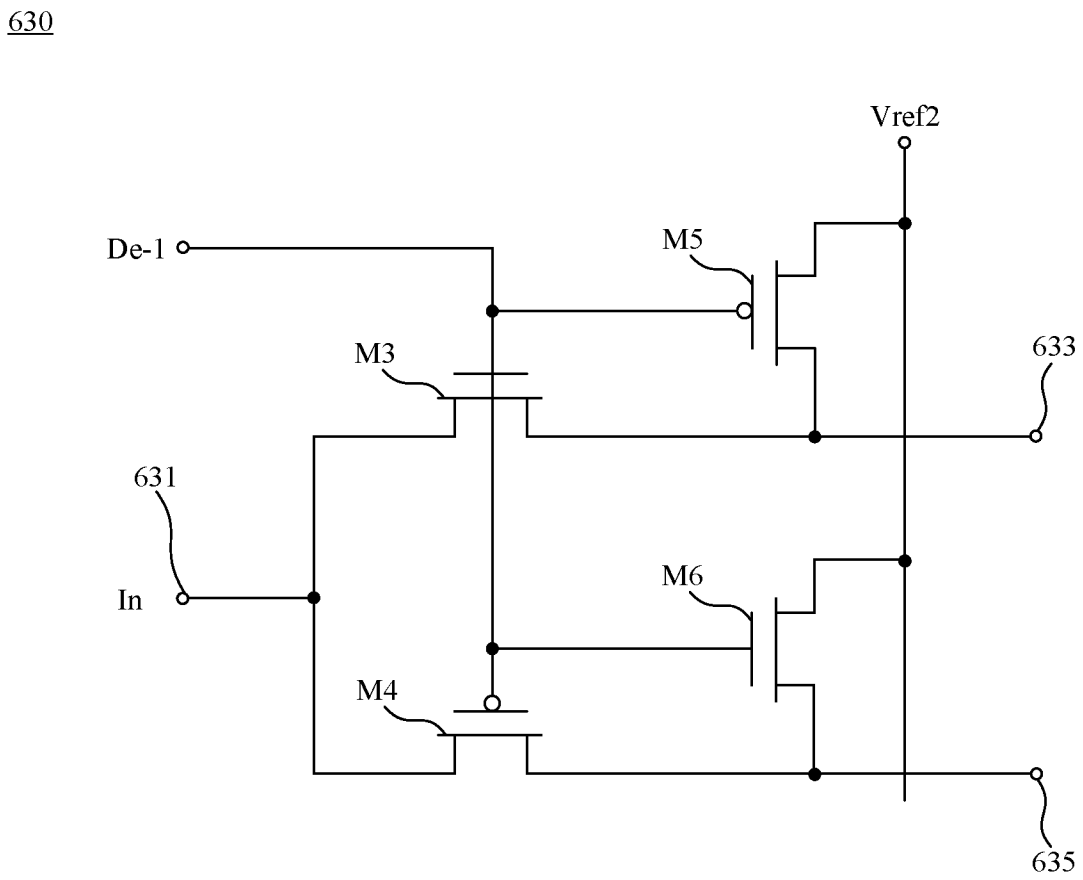
FIG. 7 is a circuit schematic diagram of a first selecting circuit according to one embodiment of the present disclosure.

FIG. 7 is a circuit schematic diagram of the first selecting circuit 630 according to one embodiment of the present disclosure. As shown in FIG. 7, the first selecting circuit 630 comprises a third transistor M3, a fourth transistor M4, a fifth transistor M5, and a sixth transistor M6. The third transistor M3 comprises a first node, a second node, and a control node. The first node of the third transistor M3 is coupled with the first output node 633 of the first selecting circuit 630. The second node of the third transistor M3 is coupled with the input node 631 of the first selecting circuit 630. The control node of the third transistor M3 is configured to receive the demultiplexing signal De-1.

The fourth transistor M4 comprises a first node, a second node, and a control node. The first node of the fourth transistor M4 is coupled with the second output node 635 of the first selecting circuit 630. The second node of the fourth transistor M4 is coupled with the input node 631 of the first selecting circuit 630. The control node of the fourth transistor M4 is configured to receive the demultiplexing signal De-1.

The fifth transistor M5 comprises a first node, a second node, and a control node. The first node of the fifth transistor M5 is configured to receive the second reference voltage Vref2, wherein the second reference voltage Vref2 has the aforementioned second voltage level. The second node of the fifth transistor M5 is coupled with the first output node 633 of the first selecting circuit 630. The control node of the fifth transistor M5 is configured to receive the demultiplexing signal De-1.

The sixth transistor M6 comprises a first node, a second node, and a control node. The first node of the sixth transistor M6 is configured to receive the second reference voltage Vref2. The second node of the sixth transistor M6 is coupled with the second output node 635 of the first selecting circuit 630. The control node of the sixth transistor M6 is configured to receive the demultiplexing signal De-1.

In practice, the third transistor M3 and the sixth transistor M6 may be realized by N-type transistors of various suitable categories. The fourth transistor M4 and the fifth transistor M5 may be realized by P-type transistors of various suitable categories.

Figure 8:
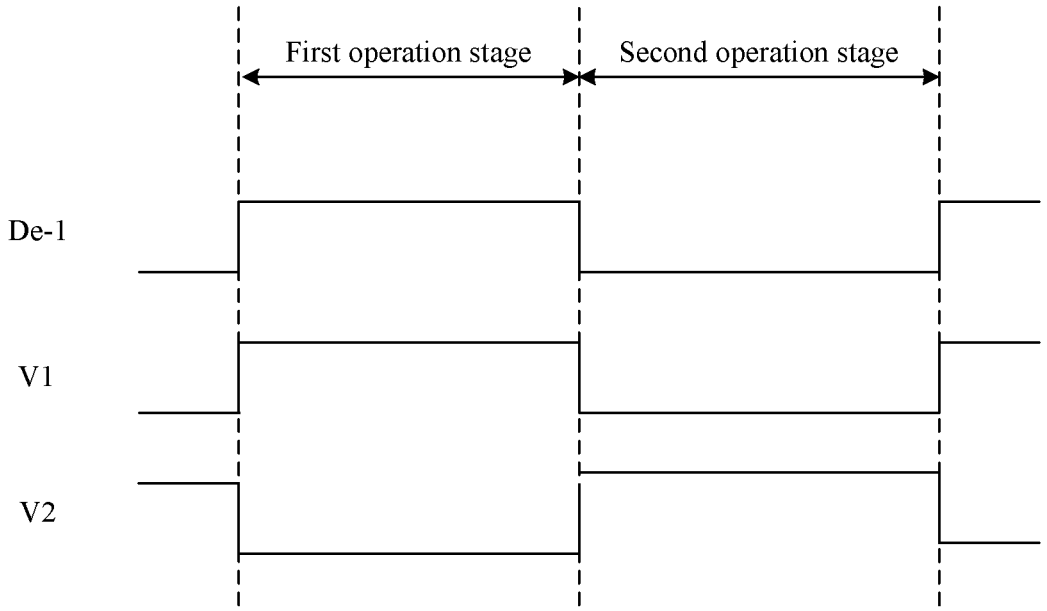
FIG. 8 illustrates the schematic waveforms of a demultiplexing signal, a first output voltage, and a second output voltage.

For the sake of brevity, the voltage of the first output node 633 of the first selecting circuit 630 is hereinafter referred to as "first output voltage V1," and the voltage of the second output node 635 of the first selecting circuit 630 is hereinafter referred to as "second output voltage V2." FIG. 8 illustrates the schematic waveforms of the demultiplexing signal De-1, the first output voltage V1, and the second output voltage V2. The operations of the first selecting circuit 630 will be further described in the following by referring to FIG. 8.

In the first operation stage, the demultiplexing signal De-1 has a high voltage level. Therefore, the third transistor M3 and the sixth transistor M6 are conducted, and the fourth transistor M4 and the fifth transistor M5 are switched off.

Figure 9:
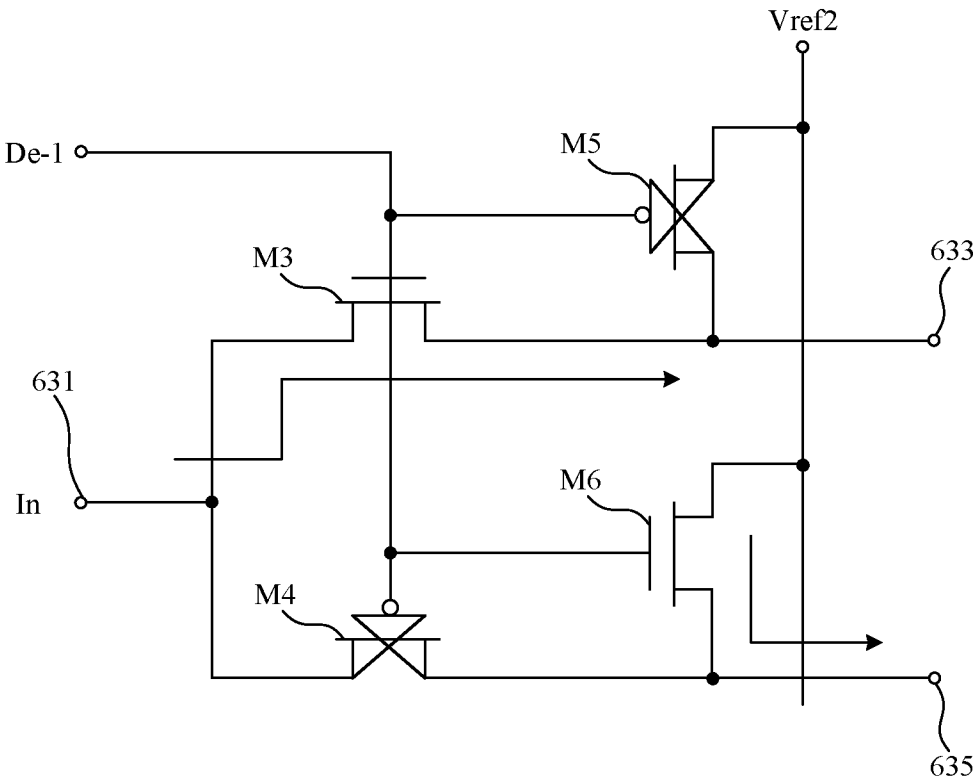
FIG. 9 is a circuit schematic diagram of an equivalent circuit of the first selecting circuit in a first operation stage.

In this situation, the first selecting circuit 630 may be represented as the equivalent circuit shown in FIG. 9. The input signal In is transmitted to the first output node 633 of the first selecting circuit 630 through the third transistor M3, so that the first output voltage V1 has a high voltage level. The second reference voltage Vref2 is transmitted to the second output node 635 of the first selecting circuit 630 through the sixth transistor M6, so that the second output voltage V2 has a low voltage level.

In the second operation stage, the demultiplexing signal De-1 has a low voltage level. Therefore, the third transistor M3 and the sixth transistor M6 are switched off, and the fourth transistor M4 and the fifth transistor M5 are conducted.

Figure 10:
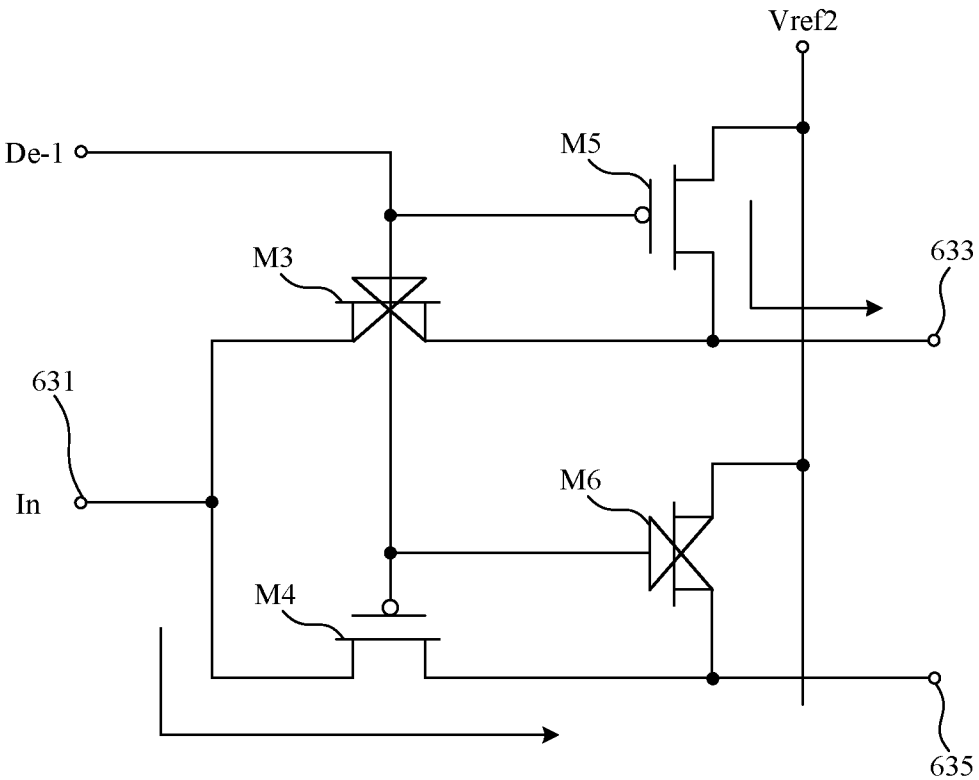
FIG. 10 is a circuit schematic diagram of an equivalent circuit of the first selecting circuit in a second operation stage.

In this situation, the first selecting circuit 630 may be represented as the equivalent circuit shown in FIG. 10. The input signal In is transmitted to the second output node 635 of the first selecting circuit 630 through the fourth transistor M4, so that the second output voltage V2 has a high voltage level. In addition, the second reference voltage Vref2 is transmitted to the first output node 633 of the first selecting circuit 630 through the fifth transistor M5, so that the first output voltage V1 has a low voltage level.

In one embodiment, the third transistor M3 and the sixth transistor M6 are realized by the P-type transistors, and the fourth transistor M4 and the fifth transistor M5 are realized by the N-type transistors. In this situation, when the demultiplexing signal De-1 has a high voltage level, the first output voltage V1 and the second output voltage V2 respectively have a low voltage level and a high voltage level. When the demultiplexing signal De-1 has a low voltage level, the first output voltage V1 and the second output voltage V2 respectively have a high voltage level and a low voltage level.

As can be appreciate form the foregoing descriptions, the transmitting path of the input signal In, which goes through the first selecting circuit 630, can be determined by adjusting the voltage level of the demultiplexing signal De-1.

The second selecting circuit 640 and the third selecting circuit 650 are similar to the first selecting circuit 630, the differences are described as follows: in the second selecting circuit 640 and the third selecting circuit 650, the control nodes of the third transistor M3 and the fourth transistor M4 are configured to receive the demultiplexing signal De-2. The foregoing descriptions regarding the implementations, connections, operations, and related advantages of other corresponding components of the first selecting circuit 630 are also applicable to the second selecting circuit 640 and the third selecting circuit 650. For the sake of brevity, those descriptions will not be repeated here.

Figure 11:
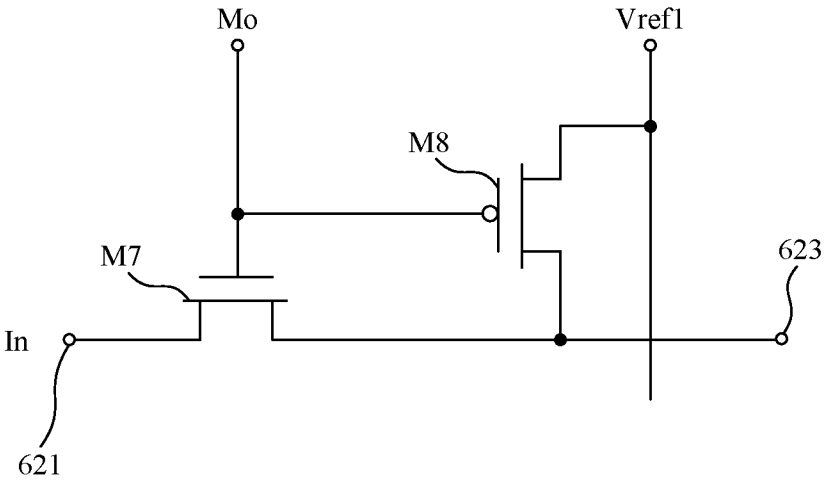
FIG. 11 is a circuit schematic diagram of a mode determining circuit according to one embodiment of the present disclosure.

FIG. 11 is a circuit schematic diagram of the mode determining circuit 620 according to one embodiment of the present disclosure. The mode determining circuit 620 comprises a seventh transistor M7 and an eighth transistor M8. The seventh transistor M7 comprises a first node, a second node, and a control node. The first node of the seventh transistor M7 is coupled with the input node 621 of the mode determining circuit 620. The second node of the seventh transistor M7 is coupled with the first output node 623 of the mode determining circuit 620. The control node of the seventh transistor M7 is configured to receive the mode determining signal Mo.

The eighth transistor M8 comprises a first node, a second node, and a control node. The first node of the eighth transistor M8 is configured to receive the first reference voltage Vref1. The second node of the eighth transistor M8 is coupled with the first output node 623 of the mode determining circuit 620. The control node of the eighth transistor M8 is configured to receive the mode determining signal Mo.

In practice, the seventh transistor M7 may be realized by an N-type transistor of various suitable categories. The eighth transistor M8 may be realized by a P-type transistor of various suitable categories.

When the mode determining signal Mo has a high voltage level, the seventh transistor M7 is conducted and the eighth transistor M8 is switched off. The input node 621 and the first output node 623 of the mode determining circuit 620 are mutually conducted. As a result, the first output voltage V1 from the second selecting circuit 640 or the second output voltage V2 from the third selecting circuit 650 may be transmitted to the switching circuit 140 as the switching signal Sw.

On the other hand, when the mode determining signal Mo has a low voltage level, the seventh transistor M7 is switched off and the eighth transistor M8 is conducted. Therefore, the first reference voltage Vref1 is transmitted to the first output node 623 of the mode determining circuit 620 through the eighth transistor M8. In this situation, the first reference voltage Vref1 is transmitted to the switching circuit 140 as the switching signal Sw.

In one embodiment, the seventh transistor M7 and the eighth transistor M8 are realized by the P-type transistor and the N-type transistor, respectively. In this situation, when the mode determining signal Mo has a high voltage level, the seventh transistor M7 is switched off and the eighth transistor M8 is conducted. When the mode determining signal Mo has a low voltage level, the seventh transistor M7 is conducted and the eighth transistor M8 is switched off.

Figure 12:
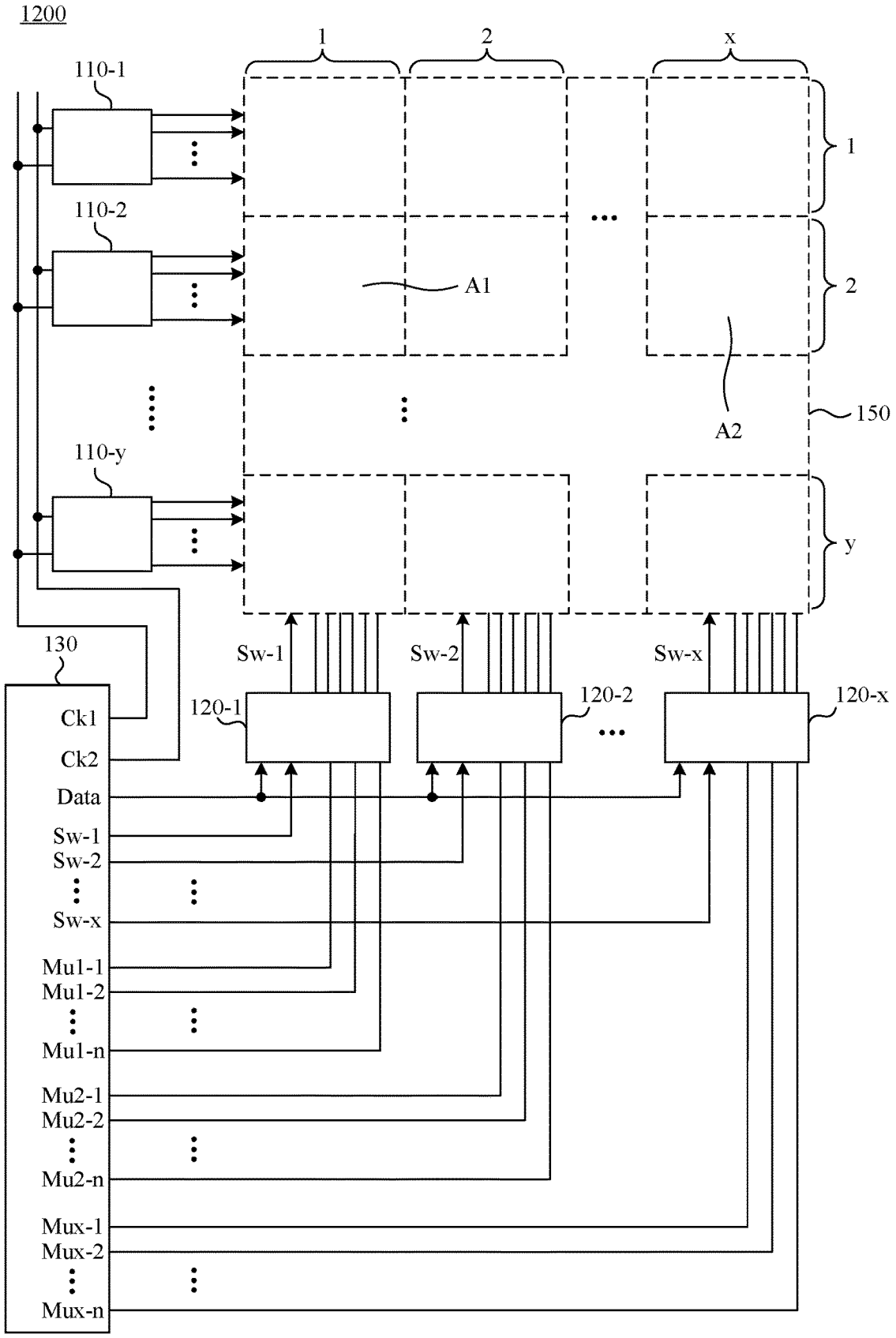
FIG. 12 is a simplified functional block diagram of a display device according to yet another embodiment of the present disclosure.

In some embodiments that having no specific requirements regarding to the width of the display border, the aforementioned switching circuits 140-1~140-*x* may be omitted. FIG. 12 is a simplified functional block diagram of a display device 1200 according to one embodiment of the present disclosure. The display device 1200 is similar to the display device 100, the differences are described as follows: the driver IC 130 of the display device 1200 directly determines that whether the multiplexer groups 120-1~120-*x* are conducted, and needs not to use the aforementioned switching circuits 140-1~140-*x* to control the multiplexer groups 120-1~120-*x*.

In specific, the driver IC 130 outputs a plurality of multiplexing signals for each of the multiplexer groups 120-1~120-*x*. For example, the driver IC 130 outputs a plurality of first multiplexing signals Mu1-1~Mu1-*n* to the multiplexer group 120-1, outputs a plurality of second multiplexing signals Mu2-1~Mu2-*n* to the multiplexer group 120-2, outputs a plurality of x-th multiplexing signals Mux-1~Mux-n to the multiplexer group 120-*x*, and so forth.

Since the display device 1200 needs not to adopt the switching circuits 140-1~140-*x*, the display device 1200 has advantages such as simple structure and high reliability. The foregoing descriptions regarding the implementations, connections, operations, and related advantages of other corresponding functional blocks in the display device 100 are also applicable to the display device 1200. For the sake of brevity, those descriptions will not be repeated here.

As can be appreciated from the foregoing descriptions, the display device 100, the display device 500, and the display device 1200 are capable of operate the sections of the active area 150 at different frame rates, and thus having the advantage of adaptively adjusting power consumption. In the situation that the display device 100, the display device 500, or the display device 1200 are adopted in a mobile device having limited power, the operating time of the mobile device can be effectively increased.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A display device, comprising:

a plurality of shift register groups, configured to receive a first clock group and a second clock group having a first frequency and a second frequency, respectively, and the first frequency is higher than the second frequency;

a plurality of multiplexer groups;

a driver IC, configured to control the plurality of shift register groups and the plurality of multiplexer groups;

a plurality of pixel circuits, arranged as a pixel array comprising rows of pixel circuits and columns of pixel circuits, wherein a shift register group of the plurality of shift register groups and a multiplexer group of the plurality of multiplexer groups cooperatively drive a part of pixel circuits of the plurality of pixel circuits;

a plurality of switching circuits, correspondingly coupled with the plurality of multiplexer groups, wherein each of the plurality of switching circuits is configured to receive, from the driver IC, a switching signal of a plurality of switching signals and a plurality of multiplexing signals, when the switching signal of the plurality of switching signals has a first voltage level, the switching circuit outputs the plurality of multiplexing signals to one of the plurality of multiplexer groups coupled with the switching circuit to enable the one of the plurality of multiplexer groups, and when the switching signal has a second voltage level, the switching circuit is disabled from outputting the plurality of multiplexing signals; and a plurality of internal signal lines, extended from a peripheral area into an active area of the display device, and configured to transmit the plurality of switching signals to the plurality of pixel circuits, wherein when the shift register group of the plurality of shift register groups and the multiplexer group of the plurality of multiplexer groups are enabled in a first time period and the shift register group of the plurality of shift register groups is configured to operate according to the first frequency, other shift register groups of the plurality of shift register groups and other multiplexer groups of the plurality of multiplexer groups are enabled in a second time period within the first time period and the other shift register groups of the plurality of shift register groups are configured to operate according to the second frequency, in which one of the plurality of switching signals received by the part of pixel circuits is maintained at the first voltage level during the first time period, wherein another of the plurality of switching signals received by the another part of pixel circuits is maintained at the first voltage level during the second time period, and is maintained at the second voltage level during a third time period, in which a length of the first time period is equal to a sum of a length of the second time period and a length of the third time period, wherein the first time period is longer than the second time period so that the part of pixel circuits and the another part of pixel circuits have a first frame rate and a second frame rate, respectively, and the first frame rate is higher than the second frame rate, wherein the plurality of pixel circuits is arranged in the active area, and the plurality of shift register groups, the plurality of multiplexer groups, the driver IC, and the plurality of switching circuits are disposed in the peripheral area.

2. The display device of claim 1, wherein the switching circuit comprises a plurality of switches, and each of the plurality of switches comprises:

a control node, configured to receive the switching signal of the plurality of switching signals;

a first node, configured to receive one of the plurality of multiplexing signals; and a second node, coupled with the one of the plurality of multiplexer groups coupled with the switching circuit.

3. The display device of claim 1, further comprising:

a plurality of peripheral signal lines, correspondingly coupled with the plurality of switching circuits, and configured to correspondingly transmit the plurality of switching signals, wherein the plurality of peripheral signal lines are arranged in the peripheral area, wherein the plurality of peripheral signal lines are extended from a first side of the display device to a second side of the display device, and the first side and the second side are opposite to each other.

4. The display device of claim 1, further comprising:

a plurality of peripheral signal lines, correspondingly coupled with the plurality of switching circuits, and configured to correspondingly transmit the plurality of switching signals, wherein the plurality of peripheral signal lines are arranged in the peripheral area, wherein a part of peripheral signal lines of the plurality of peripheral signal lines is extended from a first side of the display device to a second side of the display device, wherein another part of peripheral signal lines of the plurality of peripheral signal lines is extended from the second side to the first side, and the first side and the second side are opposite to each other.

5. The display device of claim 1, wherein the plurality of internal signal lines are arranged alternatively with the columns of pixel circuits.

6. The display device of claim 5, wherein the plurality of internal signal lines are divided into a plurality of groups, a number of the plurality of groups is equal to a number of the plurality of multiplexer groups, and internal signal lines of each of the plurality of groups are connected with each other.

7. The display device of claim 1, wherein each of the plurality of internal signal lines provides a received switching signal to a first column of pixel circuits and a second column of pixel circuits, the first column of pixel circuits and the second column of pixel circuits are adjacent to the internal signal line, and the internal signal line is arranged between the first column of pixel circuits and the second column of pixel circuits.

8. The display device of claim 1, wherein each of the plurality of internal signal lines transmits a received switching signal to some of the columns of pixel circuits sequentially arranged at a same side of the internal signal line.

9. The display device of claim 1, wherein each of the plurality of pixel circuits comprises:

a capacitor element;

a first transistor, comprising a first node, a second node, and a control node, wherein the first node of the first transistor is configured to receive a data signal, and the control node of the first transistor is configured to receive a control signal; and a second transistor, comprising a first node, a second node, and a control node, wherein the first node of the second transistor is coupled with the second node of the first transistor, the second node of the second transistor is coupled with the capacitor element, and the control node of the second transistor is coupled with one of the plurality of internal signal lines.

* * * * *